US007300129B2

(12) United States Patent
Kumamoto et al.

(10) Patent No.: US 7,300,129 B2
(45) Date of Patent: Nov. 27, 2007

(54) INKJET PRINTER

(75) Inventors: Kouichi Kumamoto, Hachioji (JP); Yoshihide Hoshino, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 297 days.

(21) Appl. No.: 10/774,635

(22) Filed: Feb. 9, 2004

(65) Prior Publication Data

US 2004/0160502 A1 Aug. 19, 2004

(30) Foreign Application Priority Data

Feb. 13, 2003 (JP) ..... 2003-035183
Jan. 6, 2004 (JP) ..... 2004-001024

(51) Int. Cl.
*B41J 29/38* (2006.01)
*B41J 2/01* (2006.01)

(52) U.S. Cl. ..... 347/16; 347/102

(58) Field of Classification Search ..... 347/102; 400/467, 468

See application file for complete search history.

(56) References Cited

U.S. PATENT DOCUMENTS 5,006,867 A * 4/1991 Koizumi et al. ..... 347/17
5,051,758 A * 9/1991 Markham ..... 347/28
5,370,745 A * 12/1994 Litteral ..... 118/669
5,572,245 A * 11/1996 Cowger ..... 347/44
5,595,118 A * 1/1997 Villaverde et al. ..... 101/424.1
6,415,118 B1 * 7/2002 Setoriyama et al. ..... 399/92
6,454,405 B1 9/2002 Stowe ..... 347/102
6,513,434 B1 * 2/2003 Nakazawa et al. ..... 101/466
6,543,890 B1 * 4/2003 Ylitalo et al. ..... 347/102
6,670,977 B2 * 12/2003 Nakanishi et al. ..... 347/228
6,864,302 B2 * 3/2005 Miyabayashi ..... 523/160
6,953,245 B2 * 10/2005 Shirakawa ..... 347/102
2004/0233244 A1 * 11/2004 Elgee et al. ..... 347/19

FOREIGN PATENT DOCUMENTS

EP 1 108 553 6/2001
JP 3-295653 12/1991
JP 5-104770 4/1993
JP 6-127077 5/1994
JP 11-208069 8/1999
JP 2001293874 A * 10/2001

* cited by examiner

*Primary Examiner*—Matthew Luu
*Assistant Examiner*—Shelby Fidler
(74) *Attorney, Agent, or Firm*—Cantor Colburn LLP

(57) ABSTRACT

An inkjet printer includes: a recording head for jetting ink cured with irradiation of light, onto a recording medium; a light source for irradiating the light toward the ink jetted on the recording medium, the light source being provided so as to face the recording medium; a media error detection mechanism for detecting a media error of the recording medium; a conveyance mechanism for conveying the recording medium in a predetermined direction; a control device for controlling the recording head and the conveyance mechanism, the control device controlling the conveyance mechanism to stop conveying the recording medium, and controlling the recording head to stop jetting the ink, when the media error of the recording medium is detected by the media error detection mechanism; and a protection member capable of being placed between the light source and the recording medium when the media error is detected.

12 Claims, 12 Drawing Sheets

INKJET PRINTER

BACKGROUND OF THE INVENTION

1. Field of the Invention

The present invention relates to an inkjet printer, in particular, an inkjet printer capable of protecting a light source when media error (jam) occurs.

2. Description of Related Art

An inkjet printer jets ink from a jet opening of a nozzle placed on one face (a nozzle face) of a recording head toward a recording medium, makes the ink land on the recording medium, and records an image on the recording medium. In the inkjet printer, in order to land the ink jetted from the nozzle onto the intended position of the recording medium, the distance between the jet opening of the nozzle and the recording medium is set narrowly on some level.

For some inkjet printers, photocurable ink is applied for recording an image on the recording medium having low ink absorbency such as resin film or the like (for example, refer to Japanese Patent Application Publication (Unexamined) Tokukai-2000-127533).

For the inkjet printer according to the Japanese Patent Application Publication (Unexamined) Tokukai-2000-127533, UV curable ink is applied. The inkjet printer comprises an irradiation device (a light source) for irradiating ultraviolet rays toward neighborhood of the recording head for jetting the ink, and irradiates ultraviolet rays to the position on which the jetted ink adheres.

In the above-mentioned related inkjet printer, the distance between the recording medium and the jet opening of the nozzle is set narrowly as mentioned above. Therefore a media error sometimes occurs because of imperfect conveyance of the recording medium such as paper or the like and other causes.

Here, the inkjet printer comprising detecting member which detects condition of the conveyance of the recording medium, and controlling member which judges whether the imperfect conveyance occurs or not based on a result detected by the detecting member and stops the recording operation carried out by the recording head when the occurrence of the imperfect conveyance is judged, is known (for example, refer to Japanese Patent Application Publication (Unexamined) Tokukaihei-11-208069).

However, even if the irradiation device or the nozzle isn't broken when the media error occurs, a user sometimes try to pull the jammed recoding medium in order to get the media error fixed. Accordingly, the jammed recording medium contacts the irradiation device or the nozzle, and stresses the irradiation device or the nozzles greatly. For these reasons, in the case that the inkjet printer according to the Japanese Patent Application Publication (Unexamined) Tokukaihei-11-208069 is simply applied, there is the problem that the irradiation device or the nozzle may be broken.

SUMMARY OF THE INVENTION

An object of the present invention is, in the view of above-mentioned problems, to provide an inkjet printer for protecting a light source from breakage by a recording medium at the time of the occurrence of media error and the time of the fixing of that.

To solve the above-mentioned problems, according to one aspect of the present invention, an inkjet printer comprises:

a recording head for jetting ink cured with irradiation of light, onto a recording medium;

a light source for irradiating the light toward the ink jetted on the recording medium, the light source being provided so as to face the recording medium;

a media error detection mechanism for detecting a media error of the recording medium;

a conveyance mechanism for conveying the recording medium in a predetermined direction;

a control device for controlling the recording head and the conveyance mechanism, the control device controlling the conveyance mechanism to stop conveying the recording medium, and controlling the recording head to stop jetting the ink, when the media error of the recording medium is detected by the media error detection mechanism; and a protection member capable of being placed between the light source and the recording medium when the media error is detected.

In accordance with the above-mentioned inkjet printer, when the media error detection mechanism detects the occurrence of the media error in the inkjet printer, the control device stops jetting the ink and conveying the recording medium (conveyance operation) by controlling the recording head and the conveyance mechanism. In addition, the control device places the protection member between the light source and the recording medium. For these reasons, the light source can be protected from being contacted directly by the recording medium. Accordingly, since the light source is protected from breakage, the inkjet printer having high reliability can be provided.

It is preferred that the protection member comprises heat insulating material.

In addition, the protection member may be formed in a meshed shape.

Additionally, the inkjet printer may further comprise a driving mechanism for driving the protection member, wherein the control device controls the driving mechanism to place the protection member between the light source and the recording medium, when the media error is detected by the media error detection mechanism.

In accordance with the above-mentioned inkjet printer, when the media error detection mechanism detects the occurrence of the media error in the inkjet printer, the control device places the protection member between the light source and the recording medium by controlling the driving mechanism. Further, the control device stops jetting the ink and conveying the recording medium (conveyance operation) by controlling the recording head and the conveyance mechanism. For these reasons, the light source can be protected from being contacted directly by the recording medium. Accordingly, the light source can be protected from breakage.

It is preferred that the protection member can be also placed between the recording head and the recording medium.

In accordance with the above-mentioned inkjet printer, when the media error occurs, the protection member is also placed between the recording head and the recording medium. Therefore, on the occasion of the occurrence or the fixing of the media error (the occasion of pulling the recording medium), not only the light source but also the recording head can be protected from breakage by the recording medium.

The inkjet printer may further comprise a head moving mechanism for moving the recording head of a serial print type in a direction perpendicular to a conveyance direction of the recording medium, wherein the control device controls the head moving mechanism to stop, when the media error of the recording medium is detected by the media error detection mechanism.

In accordance with the above-mentioned inkjet printer, when the media error detection mechanism detects the occurrence of the media error in the serial type ink-jet printer, the control device stops the movement of the recording head by controlling the head moving mechanism. Further, the control device places the protection member between the light source and the recording medium. For these reasons, the printing operation is certainly stopped on the occasion of the occurrence of the media error. Additionally, the light source and the recording head can be protected from being contacted by the recording medium. And accordingly, these members can be protected from breakage. Here, a serial print type (a serial type ink-jet printer) means an inkjet printer which records images by jetting ink from a recording head according to moving a recording head back-and-forth in a scan direction.

In addition, the inkjet printer may be of a line print type.

In accordance with the above-mentioned inkjet printer, when the media error detection mechanism detects the occurrence of the media error in the line type ink-jet printer, the control device stops the movement of the recording medium by controlling the conveyance mechanism. Further, the control device places the protection member between the light source and the recording medium. For these reasons, the printing operation is certainly stopped on the occasion of the occurrence of the media error. In addition, the light source and the recording head can be protected from being contacted directly by the recording medium. Accordingly, these members can be protected from breakage. Here, a line print type (a line type ink-jet printer) means an inkjet printer which has a recording head extending across the width direction of the recording medium (the direction perpendicular to the conveyance direction of the recording medium) and records images according to conveying the recording medium.

In addition, the inkjet printer may further comprise a luminous energy measuring member for measuring luminous energy of the light source, wherein the control device makes the luminous energy measuring member measure the luminous energy, before a recording operation is resumed after the media error is detected by the media error detection mechanism and the recording operation is stopped, and judges that the control device cannot carry out the recording when the luminous energy measured by the luminous energy measuring member is lower than a predetermined value.

In this case, it is preferred that the inkjet printer further comprises a warning member for warning a user, wherein the control device makes the warning member warn, when the control device judges that the recording operation cannot be carried out.

In addition, the controls device may prohibit resumption of the recording operation, when the control device judges that the recording operation cannot be carried out.

It is preferred that the ink is UV curable ink capable of being cured with irradiation of ultraviolet rays.

Further, it is preferred that the UV curable ink is cationic polymerization system ink.

In addition, it is preferred that the inkjet printer forms an image by jetting the ink onto the recording medium.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENTS OF THE INVENTION

Hereinafter, the embodiment of the present invention will be explained with reference to the drawings accordingly.

First Embodiment

Figure 1:
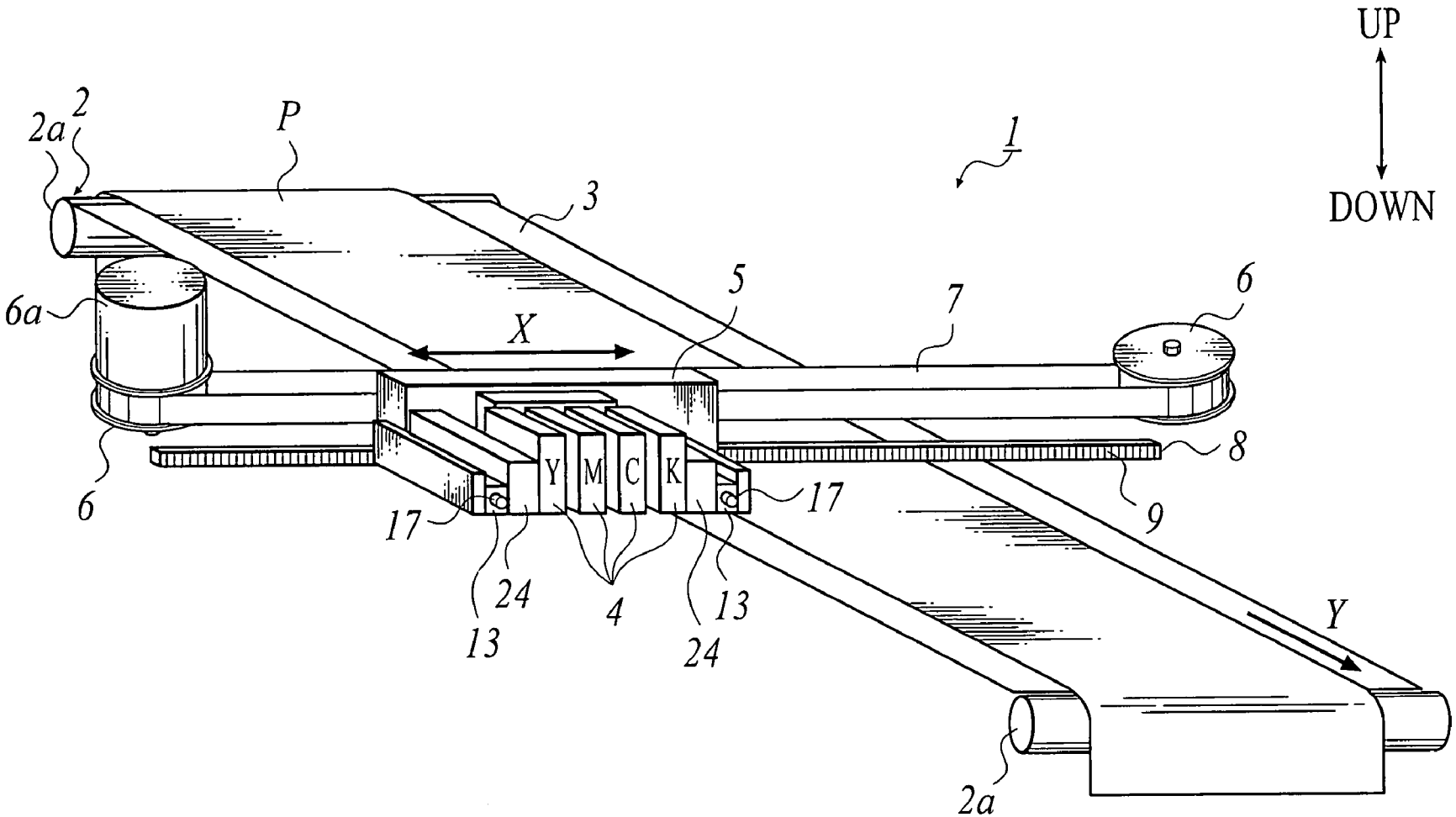
FIG. 1 is a perspective view showing a substantial part of the inkjet printer in a first embodiment.

FIG. 1 is a perspective view showing a substantial part of an inkjet printer 1 in the first embodiment. The inkjet printer 1 according to the present embodiment is a serial type inkjet printer to which UV curable ink is applied.

In addition, in the following explanations, the directions perpendicular to a main scan direction X and a sub scan direction Y are defined as the up direction and the down direction respectively.

Between conveyance rollers 2*a* and 2*a*, a flat plate-shaped platen 3 comprising a flat face parallel to the plane composed by the main scan direction X and the sub scan direction Y is placed. The platen 3 supports the backside (opposite to a recording surface) of a recording medium P. Accordingly, the distance between recording heads 4, 4, 4 and 4 and the recording medium P is kept constant.

Above the platen 3, a bar-shape guide member 8 extending in the main scan direction X is placed. On the guide member 8, a carriage 5 is placed being free to slide. Accordingly, the carriage 5 is guided along the main scan direction X. In addition, on the guide member 8, a film having an equally spaced striping 9 is stuck. In the carriage 5, a linear encoder (not shown) for scanning the striping 9 and generating a pulse signal is placed. A movement speed of the carriage 5 is measured according to the pulse signal.

On the carriage 5, the recording heads 4, 4, 4 and 4, a UV irradiation devices 24 and 24, and a protection mechanism 13 are mounted. The recording heads 4, 4, 4 and 4 are arranged on the carriage 5 along the main scan direction X. The UV irradiation devices 24 and 24 are arranged on both of the right and the left sides of the carriage 5.

Here, the ink used in the present embodiment is UV curable ink cured with the irradiation of the ultraviolet rays. For the UV curable ink, as polymerizable compounds, radical polymerization system ink including radical polymerizable compounds, cationic polymerization system ink including cationic polymerizable compounds, and hybrid type ink compounded of radical polymerization system ink and cationic polymerization system ink are applicable. In particular, it is preferred that cationic polymerization system ink, which has few inhibition behavior for polymerization reaction by oxygen and is superior in functionality and versatility, is applied. Incidentally, for the ink, polymerizable compounds which are polymerized and cured by light other than the ultraviolet rays, and photoinitiator which starts the polymerization reaction between polymerizable compounds with light other than the ultraviolet rays for example, electron beam, X-rays, infrared rays or the like, may be applied. In this case, instead of the UV irradiation devices 24, 24, the light irradiation device capable of irradiating the aforementioned light is applied.

On the carriage 5, the UV irradiation devices 24 and 24 for irradiating the ultraviolet rays toward the ink jetted on the recording medium P are mounted. The UV irradiation devices 24 and 24 comprise the ultraviolet rays source 11 (refer to FIG. 2), and a cover 12 which covers the ultraviolet rays source 11 and has an opening facing the recording surface of the recording medium P. Here, as the ultraviolet rays source 11, a high-pressure mercury lamp, a metal halide lamp, a hot cathode tube, a cold cathode tube or the like are applicable.

In addition, the protection mechanism 13 for protecting the UV irradiation devices 24 and 24 at the occurrence of the media error is placed on the side face, which is opposite to the side face on which the recording heads 4, 4, 4 and 4 are placed, of the UV irradiation devices 24.

To both sides of the platen 3 in the main scan direction X, pulleys 6 and 6 are arranged. The distance between pulleys 6 and 6 is set wider than the width of the recording medium P. In addition, the pulleys 6 and 6 are free to rotate on a rotation axis along the up-and-down direction. To one of the pulleys 6 and 6, a motor 6*a* for rotating the pulley 6 is connected.

Conveyance rollers 2*a* and 2*a*, which operate as conveyance mechanism, are free to rotate on a rotation axis along the main scan direction X. In addition, the conveyance rollers 2*a* and 2*a* are the two rollers arranged parallel to each other with the predetermined distance. At least one of the conveyance rollers 2*a* and 2*a* is connected to a motor or the like for rotating the conveyance roller 2*a*.

Between the two pulleys 6 and 6, a belt 7 is spanned. On both ends of the belt 7, the carriage 5 is fixed.

Next, referring to FIG. 2, FIG. 3A and FIG. 3B, the protection mechanism 13 will be explained in detail.

Figure 2:
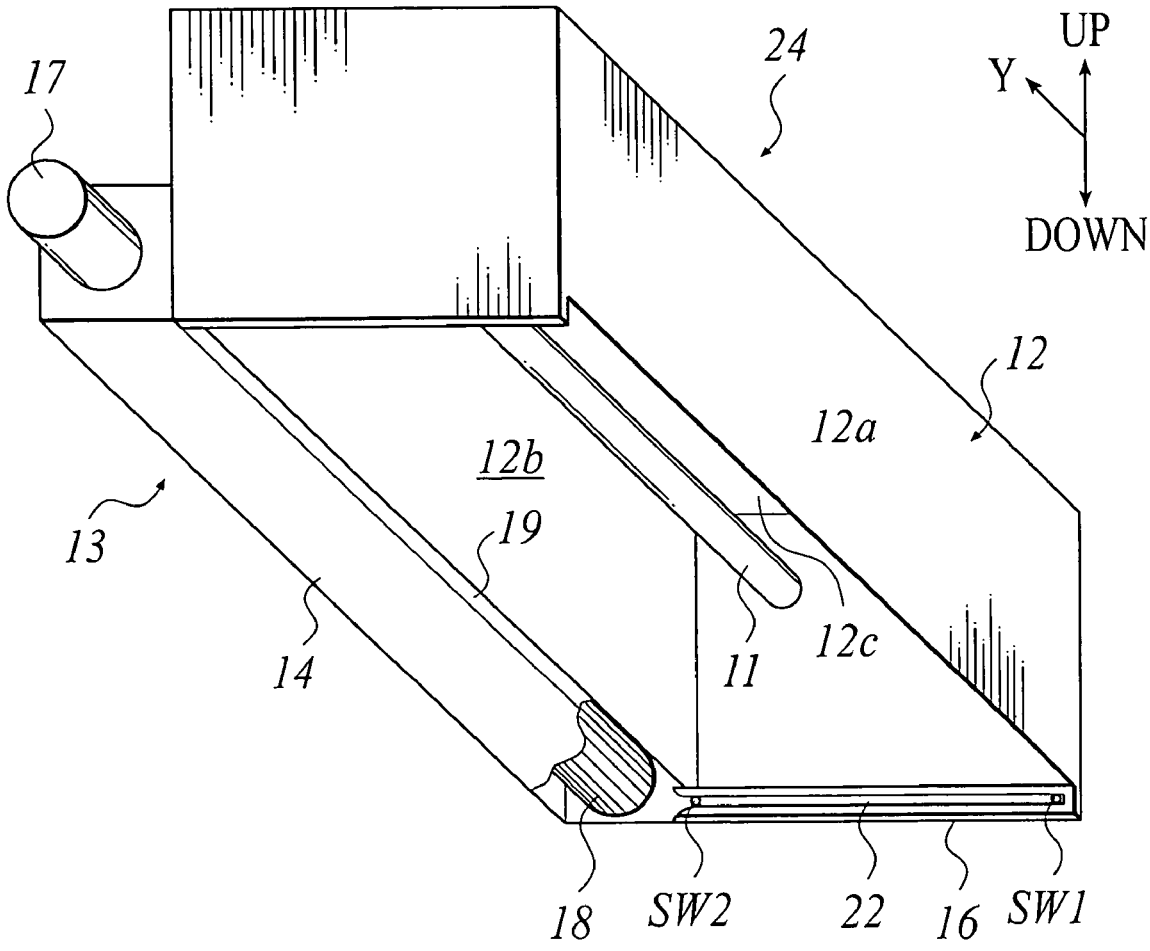
FIG. 2 is a partially cutaway perspective view viewing a UV irradiation device from lower position in the first embodiment.
Figure 3A:
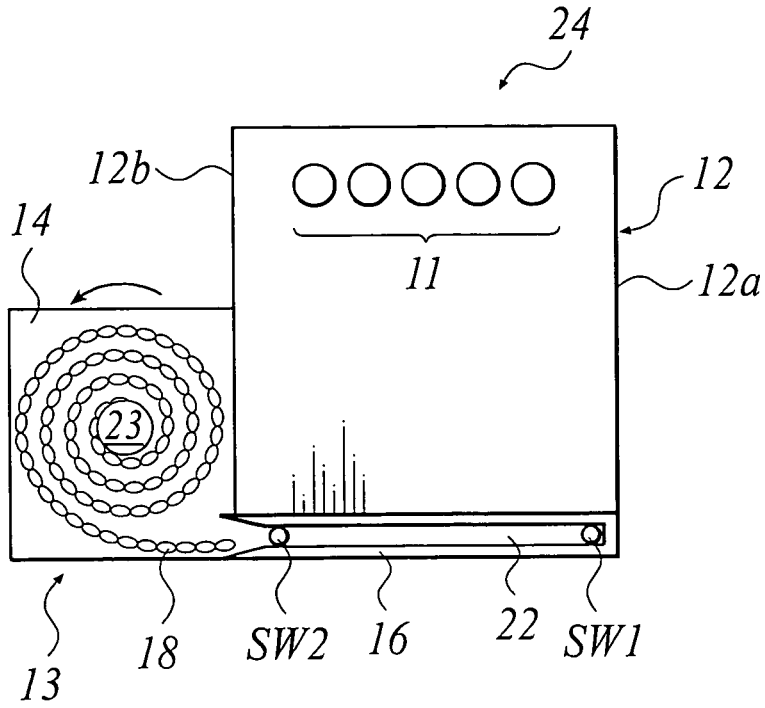
FIG. 3A is a section view showing the UV irradiation device in the state that a protection member is stored in a storage unit in the first embodiment.
Figure 3B:
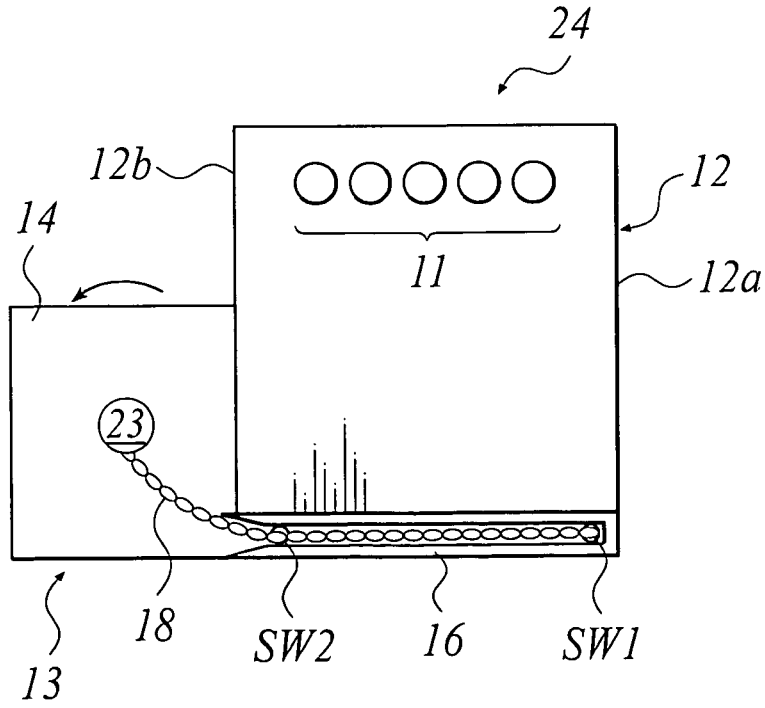
FIG. 3B is a section view showing the UV irradiation device in the state that the protection member covers an opening on the undersurface of the UV irradiation device in the first embodiment.

FIG. 2 is a partially cutaway perspective view viewing the UV irradiation device 24 from lower position in FIG. 1. FIG. 3A is a section view showing the UV irradiation device 24 in the state that a protection member 18 is stored in a storage unit 14. FIG. 3B is a section view showing the UV irradiation device 24 in the state that the protection member 18 covers an opening on the undersurface of the UV irradiation device 24.

In the first embodiment, the storage unit 14 for storing the protection member 18 is placed on a side face 12*b* of the cover 12 opposite to a side face 12*a* on which the recording head 4 is placed. The storage unit 14 is rectangular solid shape, and the length thereof in the sub scan direction Y is as long as that of the UV irradiation device 24.

In addition, the bottom edge of the storage unit 14 projects downward from the bottom edge of the cover 12. Between the bottom edge of the side face 12*b* and the undersurface of the storage unit 14, an opening 19 (refer to FIG. 2) for taking the protection member 18 into and from the storage unit 14, extends across the length of the storage unit 14 in the sub scan direction.

In addition, on the bottom edges of both end faces in the sub scan direction Y, of the UV irradiation device 24, rails 16 and 16 for guiding the protection member 18 are placed from the side face 12*b* to the side face 12*a*. The ends of the rails 16 and 16 near the side face 12*b* are continued to the aforementioned storage unit 14.

On the face of each rail 16 facing inside of the cover 12, a guide gutter 22 for guiding the protection member 18 is formed.

On one end face in the sub scan direction Y, of the storage unit 14, a motor 17 which operates as a driving mechanism for driving the protection member 18, is placed. A rotation axis 23 (FIG. 3A and FIG. 3B) extends along the sub scan direction Y, and the one end thereof is connected to the axis of the motor 17.

The protection member 18 in the first embodiment is a shutter of which flat-plate shaped members being close to each other are combined by hinges respectively. The protection member 18 comprises heat insulating materials such as phenol resin, polyimide or the like compounding glass fiber, carbon fiber or the like, for example.

One end of the protection member 18 is fixed to the rotation axis 23. Then, during the usual printing (excepting the occurrence of the media error), the protection member 18 is coiled around the rotation axis 23. In this condition, the other end of the protection member 18 is slightly engaged with the guide gutter 22 of the rail 16 (FIG. 3A).

In addition, at the end of the guide gutter 22 near the side face 12*a*, a first switch SW1 is placed. In the case that the end of the protection member 18 contacts the first switch SW1, the driving of the motor 17 is stopped.

On the other hand, also at the end near the side face 12*b* of the guide gutter 22, a second switch SW2 is placed. However, the second switch SW2 is differ from the first switch SW1. When contact between the other end of the protection member 18 and the second switch SW2 is lost, the driving of the motor 17 is stopped.

Figure 4:
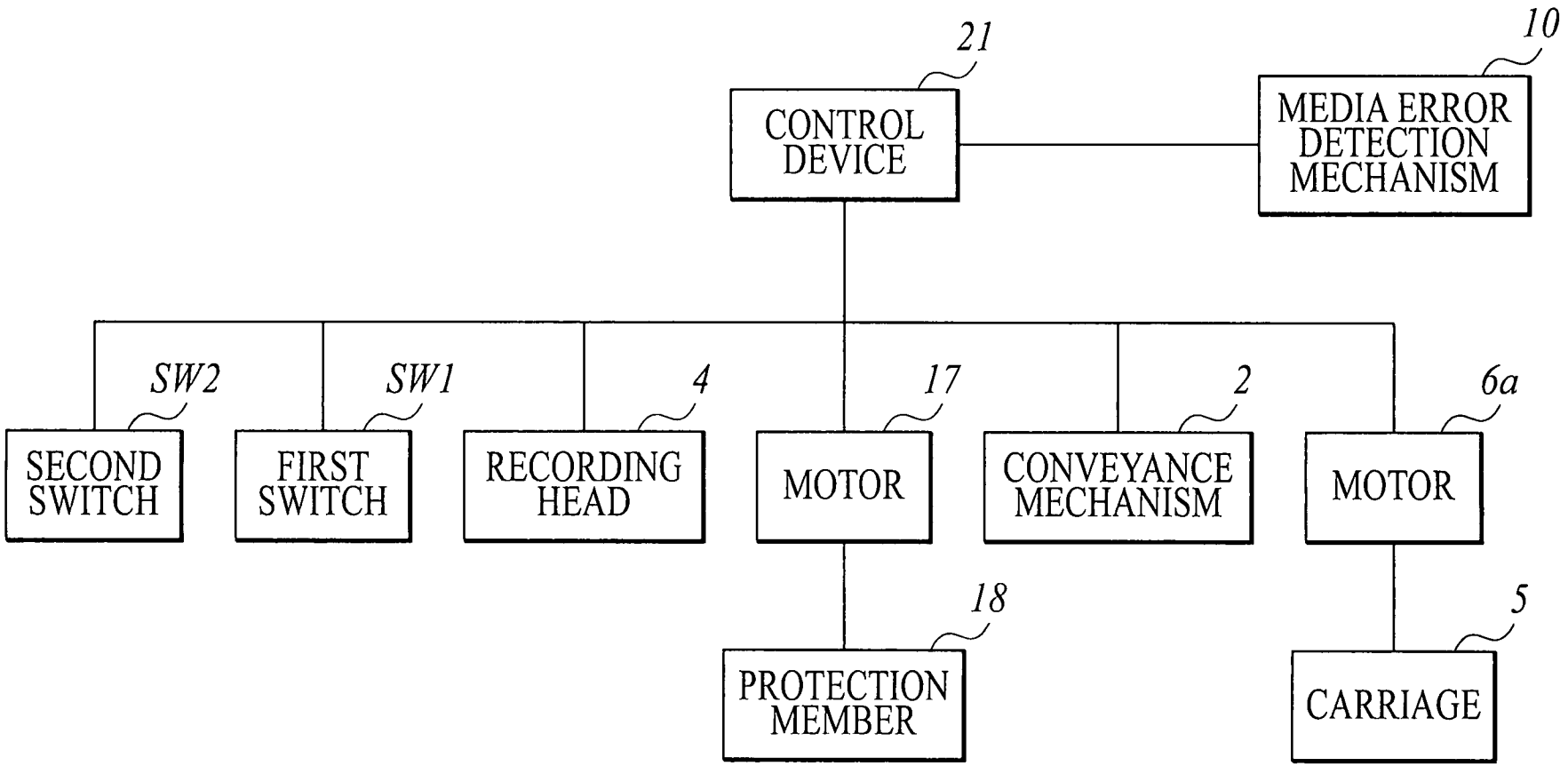
FIG. 4 is a block diagram of the inkjet printer in the first embodiment.

Next, referring to FIG. 4, a control device 21 of the inkjet printer 1 according to the first embodiment will be explained. FIG. 4 is a function block diagram of the inkjet printer 1.

In the inkjet printer 1, a media error detection mechanism 10 for sending a signal (a jam signal) to the control device 21 when the media error occurs, is placed. The media error detection mechanism 10 comprises the striping 9 provided on the guide member 8, the linear encoder placed in the carriage 5, and a comparing unit (not shown) which reads a pulse generated by the linear encoder and compares the movement speed of the carriage 5 with the regulation speed memorized beforehand.

The control device 21 is connected to the recording heads 4, 4, 4 and 4 to stop jetting the ink when the signal (the jam signal) is received. In addition, the control device 21 is connected to the motor 17 to place the protection member 18 between the recording medium P and the light source by driving the protection member 18, when the signal (the jam signal) is received. In addition, the control device 21 is connected to the first switch SW1 for stopping the movement of the protection member 18 when the protection member is placed between the recording medium P and the light source. In addition, the control device 21 is connected to the second switch SW2 for stopping the movement of the protection member 18 when the protection member is removed from between the recording medium and the light source after the media error has been fixed.

In addition, the control device 21 is connected to a conveyance mechanism 2 to stop conveying the recording medium P when the signal (the jam signal) is received, and to prevent further deterioration of the media error. Further, the control device 21 is connected to the motor 6*a* to stop the movement of the carriage 5 when the signal (jam signal) is received.

Next, an operation of the inkjet printer 1 according to the first embodiment will be explained referring to FIG. 1 to FIG. 4.

During the operation of the inkjet printer 1, the conveyance rollers 2*a* and 2*a* rotate, and the recording medium P is conveyed in the sub scan direction Y while the backside thereof (the opposite side of the recording surface) is supported by the platen 3. And accordingly, by the driving of the motor 6*a*, the carriage 5, which is fixed on the belt 7 spanned between the pulleys 6 and 6, moves back and forth in the main scan direction X.

Then, during the back-and-forth movement of the carriage 5, the ink is jetted from the recording heads 4, 4, 4 and 4 mounted in the carriage 5 onto the recording surface of the recording medium P. In other words, in the inkjet printer 1, the recording medium P is conveyed in the sub scan direction Y by the conveyance mechanism 2, in synchronization with the back-and-forth movement of the carriage 5. Accordingly, during the conveyance, the ink is jetted onto the recording surface of the recording medium P.

To both right-and-left sides of the carriage 5, the UV irradiation devices 24 and 24 for irradiating the ultraviolet rays onto the recording surface of the recording medium P are placed. The ink jetted from the recording heads 4, 4, 4 and 4 onto the recording surface of the recording medium P is cured with the irradiation of the ultraviolet rays.

Here, the case that the media error occurs will be considered. When the media error occurs, the movement of the carriage 5 along the main scan direction X is interrupted by a jammed recording medium P. And accordingly, the movement speed of the carriage 5, which is measured based on the pulse signal generated by the linear encoder placed in the carriage 5, becomes slower than the predetermined regulation speed. The slowing of the movement speed is detected by the comparing unit in the media error detection mechanism 10.

Then the media error detection mechanism 10 sends the signal (the jam signal) to the control device 21. In addition, the control device 21 controls the recording heads 4, 4, 4 and 4, the conveyance mechanism 2 and the motor 6*a*. Accordingly, the control device 21 stops jetting the ink from the recording heads 4, 4, 4 and 4, conveying the recording medium P, and the back-and-forth movement of the carriage 5, respectively.

At the same time, the control device 21 controls the motor 17 of the protection mechanism 13, and drives it. The protection member 18, which has been coiled around the rotation axis 23, is uncoiled by the diving of the motor 17. Further, the protection member 18 moves in the predetermined direction so as to cover the opening on the undersurface of the UV irradiation device 24 while the protection member 18 is guided by the guide gutter 22. Then, when the other end of the protection member 18 contacts the first switch SW1 placed on a fore-end in the predetermined direction of the guide gutter 22, the driving of the motor 17 is stopped. And accordingly, the protection member 18 is placed between the ultraviolet rays source 11 and the recording medium P (FIG. 3B).

In addition, when the media error is fixed by removing the jammed recording medium P or the like, the user pushes a reset button placed on the inkjet printer 1. By such an opportunity or the like, the motor 17 rotates in the reverse direction to that on the occasion of the occurrence of the media error. Accordingly, the protection member 18 is coiled around the rotation axis 23. Then, when the contact between the protection member 18 and the second switch SW2 placed at the end near the side face 12*b* of the guide gutter 22 is lost, the driving of the motor 17 is stopped. And accordingly, the protection member 18 is stored in the storage unit 14, in the state that the other end of the protection member 18 is engaged with the guide gutter 22 (FIG. 3A).

As mentioned above, in the inkjet printer 1 according to the first embodiment, when the media error is detected, the protection member 18 is placed immediately between the ultraviolet rays source 11 and the recording medium P. Therefore, the ultraviolet rays source 11 is protected from being contacted directly by the jammed recording medium P. Further, the light source 11 is protected from breakage. In addition, even if the recording medium P is pulled out to fix the media error, the protection member 18 has already been placed between the recording medium P and the ultraviolet rays source 11. Therefore, the light source 11 is not contacted directly by the recording medium P. And accordingly, the ultraviolet rays source 11 is protected from breakage.

In addition, the protection member 18 comprises heat insulating material. Therefore, even if the recording medium P melted with heat, such as a synthetic resin film or the like for example, is applied, the heat generated by the ultraviolet rays source 11 is insulated by the protection member 18 and not transferred to the recording medium P. Therefore, during the period from the stop of the conveyance of the recording medium P caused by the imperfect conveyance of the recording medium P to removal of the recording medium P, the recording medium P can be protected from being melted with the heat of the ultraviolet rays source 11 and being stuck on the platen.

Incidentally, in the present embodiment, the media error is detected by measuring the movement speed of the carriage 5. However, the way of detecting the media error is not limited to that. For example, the media error can be also detected by measuring the rotational speed of the motor 6*a*, measuring the conveyance speed of the recording medium P or the like.

Second Embodiment

Figure 5:
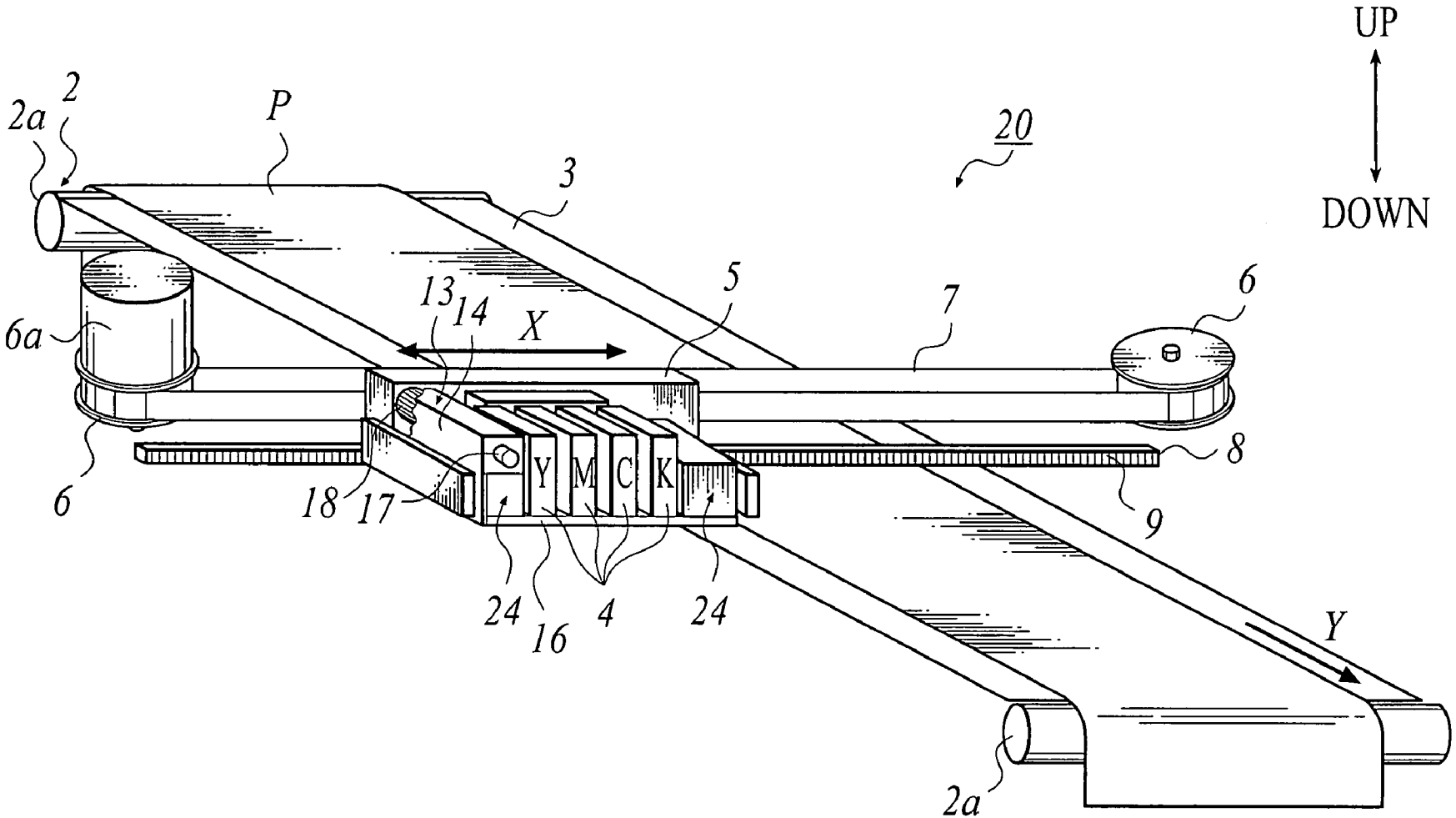
FIG. 5 is a perspective view showing a substantial part of the inkjet printer in a second embodiment.
Figure 6A:
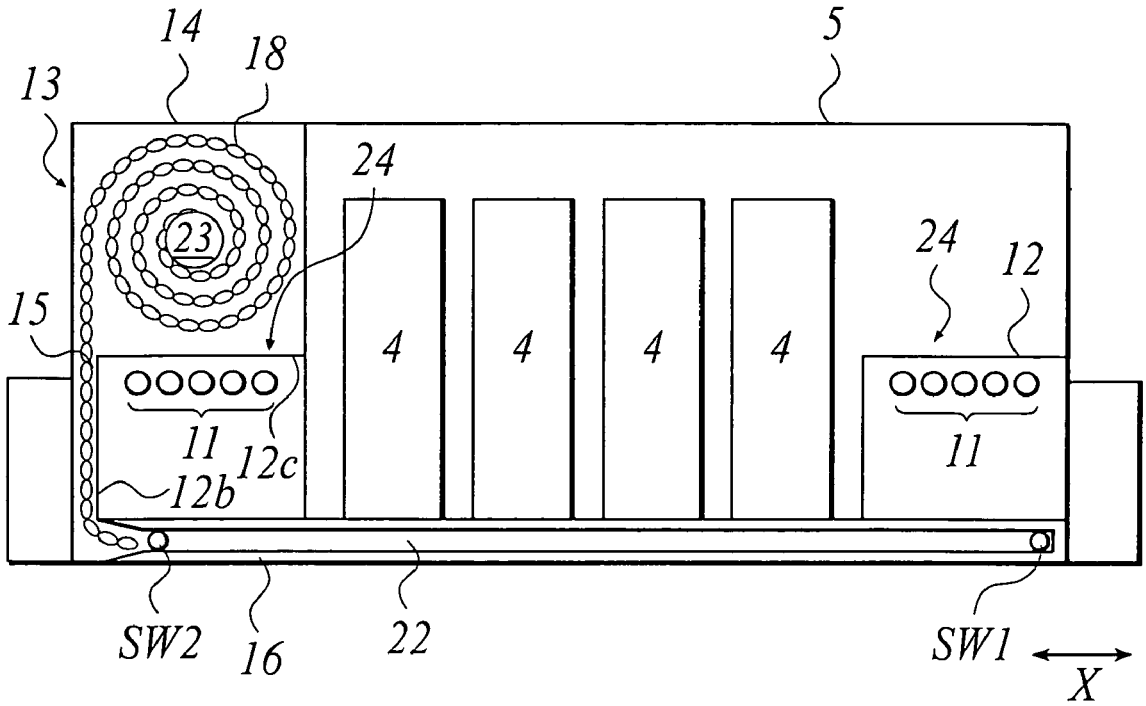
FIG. 6A is a section view showing a carriage in the state that a protection member is stored in a storage unit in the second embodiment.
Figure 6B:
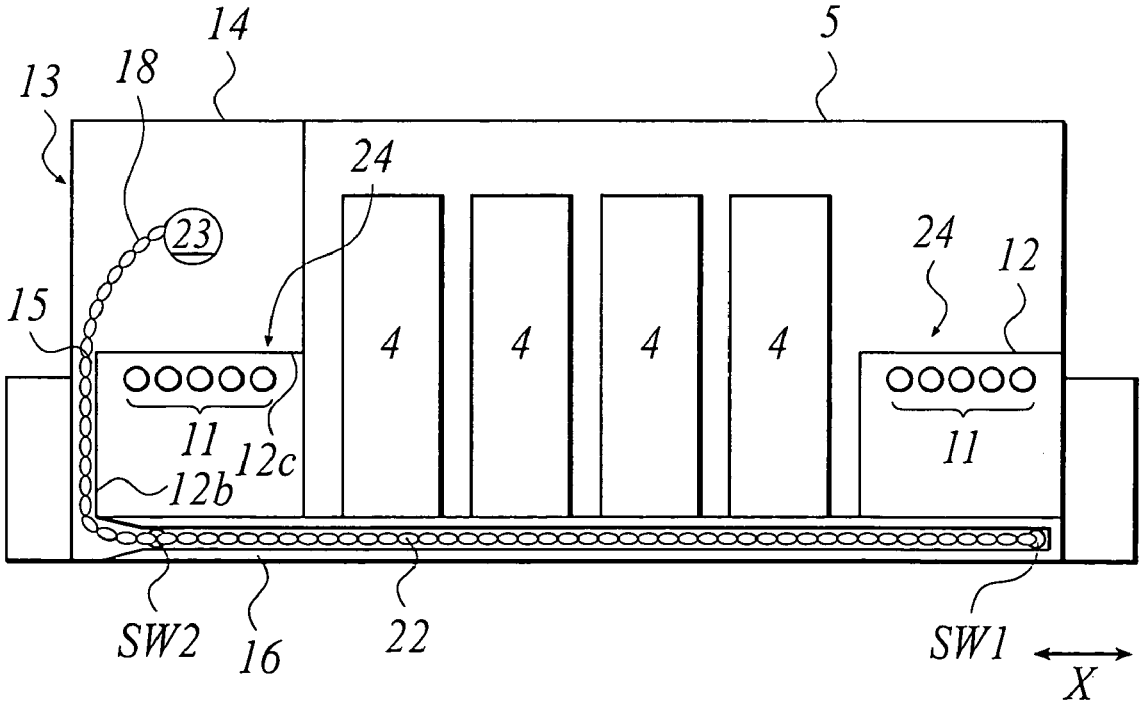
FIG. 6B is a section view showing the carriage in the state that the protection member covers the UV irradiation device and the recording head in the second embodiment.

FIG. 5 is a perspective view showing a substantial part of an inkjet printer 20 in the second embodiment. FIG. 6A is a section view showing a carriage 5 in the state that a protection member 18 is stored in a storage unit 14. FIG. 6B is a section view showing the carriage 5 in the state that the protection member 18 covers a UV irradiation device 24 and recording heads 4, 4, 4 and 4.

The inkjet printer 20 in the present embodiment is a serial type inkjet printer to which UV curable ink is applied. The inkjet printer 20 differs from the ink-jet printer of the first embodiment in that not only the UV irradiation device 24 but also the recording heads 4, 4, 4 and 4 are covered with the protection member 18 when the media error occurs.

Hereinafter, a protection mechanism 13 will be explained. The protection mechanism 13 comprises the storage unit 14, a rail 16, a motor 17 operating as a driving mechanism, and the protection member 18.

In the second embodiment, the storage unit 14, which is approximate rectangular solid shaped, is placed on a upper surface 12*c* of a cover 12 composing the UV irradiation device 24 in the left side of the figure. The storage unit 14 projects slightly from the upper surface 12*c* to the left in a main scan direction X (refer to FIG. 6A and FIG. 6B). Between a sidewall of the storage unit 14 in the left of the figure and a side face 12*b* of the cover 12, a gap for comings and goings of the protection member 18 is formed.

Further, the sidewall of the storage unit 14 in the left of the figure extends downward beyond the bottom edge of the UV irradiation device 24. In addition, between the side face 12*b* of the UV irradiation device 24 and the sidewall of the storage unit 14 in the left of the figure, a passage 15 for the protection member 18 is formed. The bottom end of the passage is continued to each rail 16.

In addition, in the second embodiment, the recording heads 4, 4, 4 and 4 are also protected with the protection member 18. Therefore, each rail 16 for guiding the protection member 18 extends from the left edge of the bottom end of the UV irradiation device 24 in the left of the figure, via the under surface of the recording heads 4, 4, 4 and 4, to the right edge of the bottom end of the UV irradiation device 24 in the right of the figure.

As the protection member 18 in the second embodiment, a shutter similar to that of the first embodiment.

Next, as for an operation of the inkjet printer 20 according to the second embodiment, the case that the media error occurs will be explained mainly with reference to FIG. 4 to FIG. 6B.

When the media error occurs in the inkjet printer 20, a media error detection mechanism 10 sends a signal (jam signal) to a control device 21. In addition, the control device 21 controls the recording heads 4, 4, 4 and 4, a conveyance mechanism 2, and a motor 6*a*. Accordingly, the control device 21 stops jetting the ink from the recording heads 4, 4, 4 and 4, conveying the recording medium P, and the back-and-forth movement of the carriage 5, respectively.

At the same time, the control device 21 drives the motor 17 of the protection mechanism 13 to uncoil the protection member 18. The protection member 18 moves so as to cover an opening on the undersurface of the UV irradiation device 24 and the under surface of the recording heads 4, 4, 4 and 4, while the protection member 18 is guided by a guide gutter 22 until it contacts a first switch SW1. Accordingly, the protection member 18 is placed between ultraviolet rays sources 11 and 11 and the recording heads 4, 4, 4 and 4, and the recording medium 18 (FIG. 6B).

After that, when the media error is fixed, the motor 17 rotates in the reverse direction. Accordingly, the protection member 18 is coiled around a rotation axis 23. Then, when the contact between the protection member 18 and a second switch SW2 is lost, the driving of the motor 17 is stopped. Accordingly, the protection member 18 is stored in the storage unit 14, in the state that the other end thereof is engaged with the guide gutter 22 (FIG. 6A).

As mentioned above, in the inkjet printer 20 according to the second embodiment, when the media error is detected, the protection member 18 is immediately placed, between the ultraviolet rays source 11 and the recording heads 4, 4, 4 and 4, and the recording medium P. Therefore, the ultraviolet rays source 11 and the recording heads 4, 4, 4 and 4 are protected from being contacted directly by the jammed recording medium P. Accordingly, the ultraviolet rays source 11 and the recording heads 4, 4, 4 and 4 are protected from breakage. In addition, even if the recording medium P is pulled out to fix the media error, the protection member 18 is already placed between the recording medium P and the ultraviolet rays source 11. Therefore, the ultraviolet rays source 11 and the recording heads 4, 4, 4 and 4 are not contacted directly by the recording medium P. Accordingly, the ultraviolet rays source 11 and the recording heads 4, 4, 4 and 4 are protected from breakage.

Incidentally, in the second embodiment, the ultraviolet rays source 11 and the recording heads 4, 4, 4 and 4 are protected with one protection member 18 when the media error occurs. However, for example, it is permitted that a protection member for protecting the recording heads 4, 4, 4 and 4 and a protection member for protecting the ultraviolet rays source 11 are provided independently and each of them is driven by a different driving mechanism respectively. By doing so, the time required to cover the recording heads 4, 4, 4 and 4 and the ultraviolet rays source 11 by protection members can be shorter.

Third Embodiment

Figure 7:
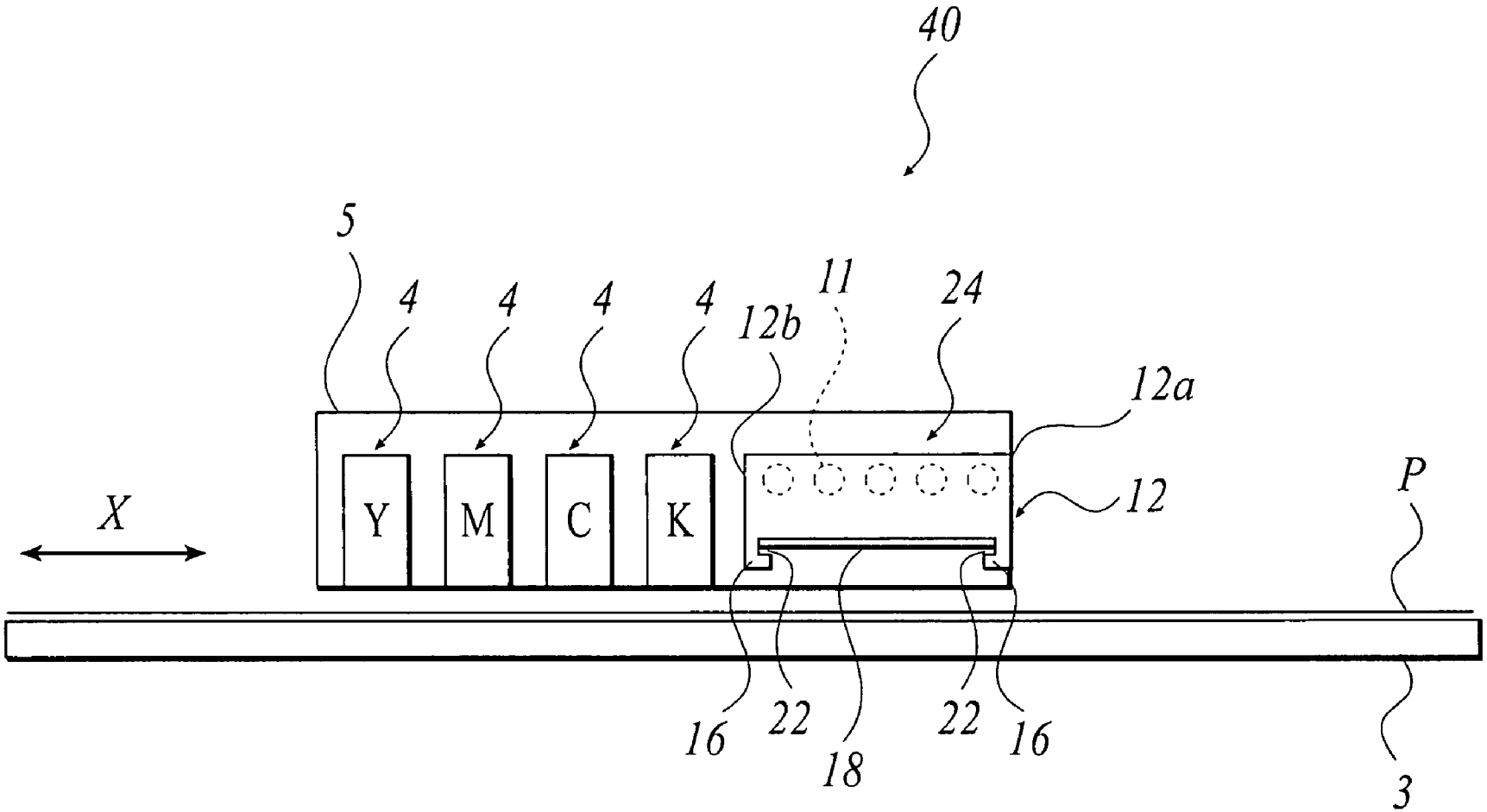
FIG. 7 is a pattern diagram showing a substantial part of the inkjet printer in a third embodiment.

FIG. 7 is a pattern diagram showing a substantial part of an inkjet printer 40 according to the third embodiment. The inkjet printer 40 in the present invention is a serial type inkjet printer to which UV curable ink is applied. Incidentally, the inkjet printer 40 according to the present embodiment has similar structure as that of the first embodiment except the structure as for the protection member 18. Therefore, hereinafter, the difference from the first embodiment will be explained mainly.

The inkjet printer 40 supports the backside (the opposite side to the recording surface) of the recording medium P conveyed in the direction perpendicular to the page (the sub scan direction Y). The inkjet printer 40 comprises a flat-plate shaped platen 3. The platen 3 extends in a sub scan direction Y.

Above the platen 3, a carriage 5 on which recording heads 4, 4, 4 and 4 and a UV irradiation device 24 are arranged is placed. The carriage 5 is movable in the back-and-forth direction along a main scan direction X by a carriage driving mechanism which is not shown in the figure.

On the under surfaces of the recording heads 4, 4, 4 and 4 (the surfaces facing the recording surface of the recording medium P), a plurality of jet openings are formed along the sub scan direction Y. Inside of the recording heads 4, 4, 4 and 4, piezo-electric elements or the like are provided. The ink is jetted respectively from each jet opening as minute liquid drops by the operation of the elements. In the present embodiment, there are four recording heads 4, 4, 4 and 4. In each recording head 4, from the recording head 4 in the left side of the figure, the ink of each color of yellow (Y), magenta (M), cyan (C) and black (K) is stored.

In the carriage 5, the UV irradiation device 24 is placed to the right of the recording heads 4, 4, 4 and 4, in the figure. The UV irradiation device 24 comprises an ultraviolet rays source 11, and a cover 12 which covers the ultraviolet rays source 11 and has an opening facing the recording surface of the recording medium P. In addition, the UV irradiation device 24 is formed of approximate rectangular solid shape. The length of the UV irradiation device 24 along the sub scan direction Y is set longer than the length of the jet openings of the recording heads 4, 4, 4 and 4 along the sub scan direction Y.

At the bottom ends of both side faces 12*a* and 12*b* of the cover 12, rails 16 and 16 extending across the length of the UV irradiation device 24 along the sub scan direction Y are placed. In addition, on the faces of the rails 16 and 16 facing each other, guide gutters 22 and 22 are placed for guiding a protection member 18.

The flat-plate shaped protection member 18 is provided as an another member to the UV irradiation device 24. At the guide gutters 22 and 22, the protection member 18 is provided so as to be detachable by manual operation. The protection member 18 is formed in a meshed shape by crossing long slender metals each other. In addition, the protection member 18 is formed so that the width thereof is approximately same as the distance between both guide gutters 22 and 22, and the length thereof is approximately same as the length of the UV irradiation device 24.

Next, an operation of the inkjet printer 40 according to the third embodiment will be explained.

During the operation of the inkjet printer 40, the recording medium P is conveyed in the sub scan direction Y while the backside thereof is supported by the platen 3. Accordingly, the carriage 5 moves back and forth in the main scan direction X.

During the back-and-forth movement of the carriage 5, the ink is jetted from the jet openings of the recording heads 4, 4, 4 and 4 onto the recording surface of the recording medium P. The ink landed on the recording medium P is cured with the irradiation of the ultraviolet rays from the UV irradiation device 24.

Here, the case that the media error occurs will be considered. When the media error occurs, the movement of the carriage 5 in the main scan direction X is stopped by the jammed recording medium P.

The user inserts the protection member 18 between both guide gutters 22 and 22 by manual operation, when the media error occurs. Accordingly, the protection member 18 is placed between the ultraviolet rays source 11 and the recording medium P.

According to the third embodiment, when the media error occurs, the protection member 18 is placed between the ultraviolet rays source 11 and the recording medium P. Therefore, the ultraviolet rays source 11 is protected from being contacted directly by the recording medium P when the media error has occurred. Accordingly, the ultraviolet rays source 11 is protected from breakage. In addition, since no additional driving mechanisms for driving the protection member 18 are necessary for being placed in the UV irradiation device 24, the UV irradiation device 24 can be made smaller and lighter. Further, since the protection member 18 is formed in a meshed shape, the protection member 18 can be trimmed weight thereof.

Fourth Embodiment

Figure 8:
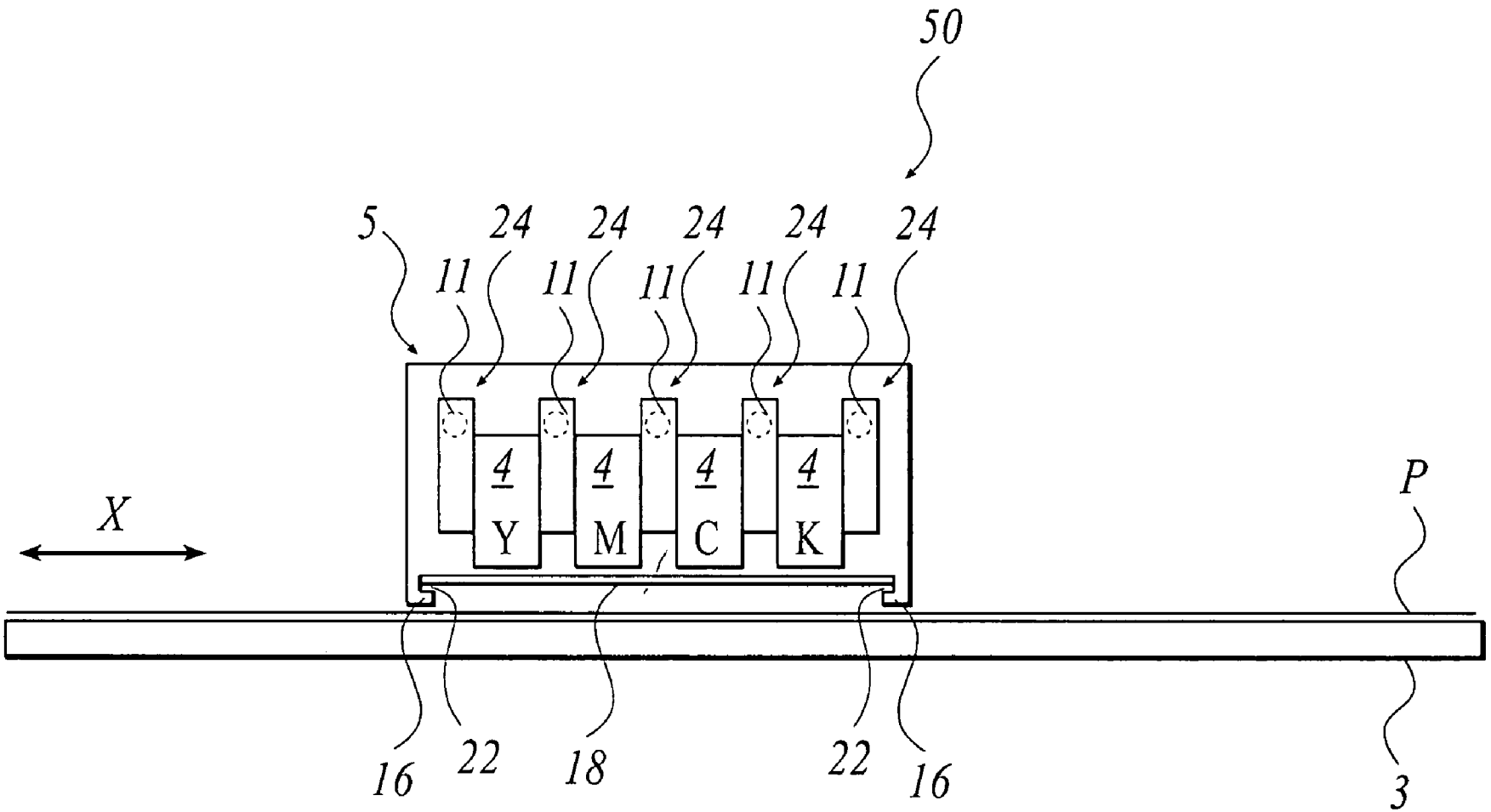
FIG. 8 is a pattern diagram showing a substantial part of the inkjet printer in a fourth embodiment.

FIG. 8 is a pattern diagram showing a substantial part of an inkjet printer 50 in the fourth embodiment. The inkjet printer 50 in the present invention is a serial type inkjet printer to which UV curable ink is applied.

Hereinafter, the difference from the third embodiment will be explained mainly. In the inkjet printer 50 in the present embodiment, the arrangements of the recoding heads 4, 4, 4 and 4 and the UV irradiation device 24 differ from those of the third embodiment. In the present embodiment, each UV irradiation device 24 and each recording head 4 are placed alternately being close to each other. In other words, each of three UV irradiation devices 24, 24 and 24 is placed at each interval between the four recording heads 4, 4, 4 and 4. Further, each of two UV irradiation devices 24 and 24 is also placed respectively to the left of the most left recording head 4 and to the right of the most right recording head 4.

In accordance with the change of the arrangement of the recording heads 4, 4, 4 and 4 and the UV irradiation devices 24, 24 . . . , rails 16 and 16 for guiding a protection member 18 are placed on each bottom edge of end faces of the carriage 5 in a main scan direction X. The length of the rails 16 and 16 in a sub scan direction Y is set longer than the length of the recording heads 4, 4, 4 and 4 and the UV irradiation devices 24, 24 . . . in the sub scan direction Y.

In addition, the protection member 18 inserted into the guide gutters 22 and 22 of the rails 16 and 16 are also larger than that of the first embodiment so that the protection member 18 can cover the recording heads 4, 4, 4 and 4 and the UV irradiation devices 24, 24 . . . .

An operation of the inkjet printer 50 in the fourth embodiment will be explained mainly in respect of the difference from the third embodiment.

When a media error occurs in the inkjet printer 50 of the fourth embodiment, the movement of the carriage 5 in the main scan direction X is stopped by the jammed recording medium P.

The user inserts the protection member 18 between both guide gutter 22 and 22 by manual operation, when the media error occurs. Accordingly, the protection member 18 is placed between each ultraviolet rays source 11 and the recording heads 4, 4, 4 and 4, and the recording medium P.

According to the fourth embodiment, when the media error occurs, the protection member 18 is placed between the ultraviolet rays source 11 and recording heads 4, 4, 4 and 4, and the recording medium P. Therefore, the ultraviolet rays source 11 and the recording heads 4, 4, 4 and 4 are protected from being contacted directly by the recording medium P when the media error has occurred. Accordingly, the ultraviolet rays source 11 and the recording heads 4, 4, 4 and 4 are protected from breakage. In addition, since no additional driving mechanisms for driving the protection member 18 are necessary for being placed in the UV irradiation device 24, the UV irradiation device 24 can be made smaller and lighter.

Fifth Embodiment

Figure 9:
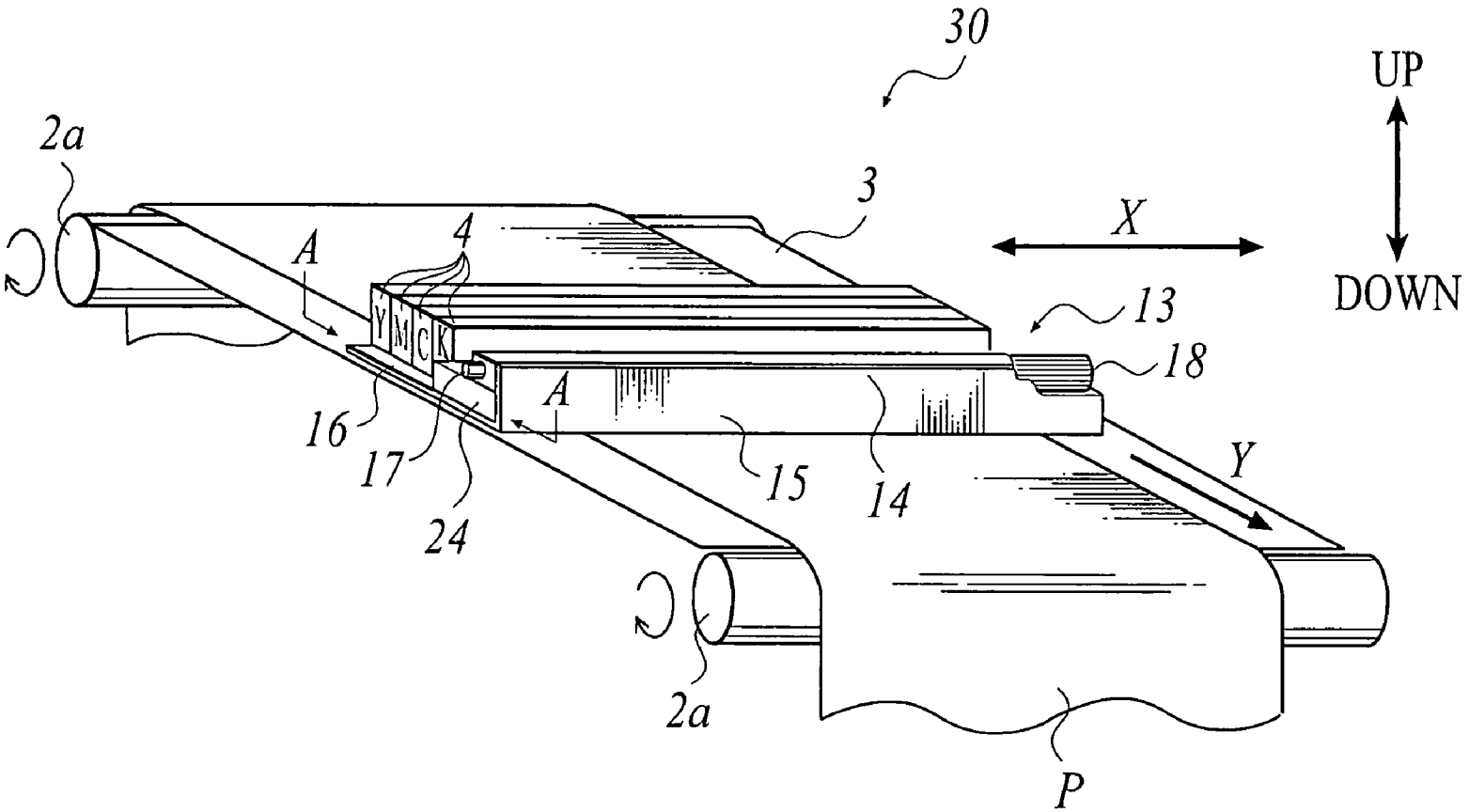
FIG. 9 is a perspective view showing a substantial part of the inkjet printer in a fifth embodiment.

FIG. 9 is a perspective view showing a substantial part of an inkjet printer 30 according to the fifth embodiment.

The inkjet printer 30 is a line type inkjet printer to which UV curable ink is applied.

The inkjet printer 30 comprises a conveyance mechanism comprising conveyance rollers 2*a* and 2*a* for conveying the recording medium P in a conveyance direction (a sub scan direction Y). And the inkjet printer 30 comprises four recording heads 4, 4, 4 and 4 having the length longer than the width of the recording medium P and extending in a main scan direction X. In addition, the inkjet printer 30 comprises a UV irradiation device 24, which is placed to the most downstream side of the recording heads 4, 4, 4 and 4 in the conveyance direction of the recording medium P (the sub scan direction Y), has the length longer than the length of the recording heads 4, 4, 4 and 4 in the main scan direction X, and extends in the main scan direction X. Further, inkjet printer 30 comprises a protection mechanism 13 for placing the protection member 18 between the ultraviolet rays source 11 and the recording heads 4, 4, 4 and 4, and the recording medium P when the media error occurs.

Figure 10A:
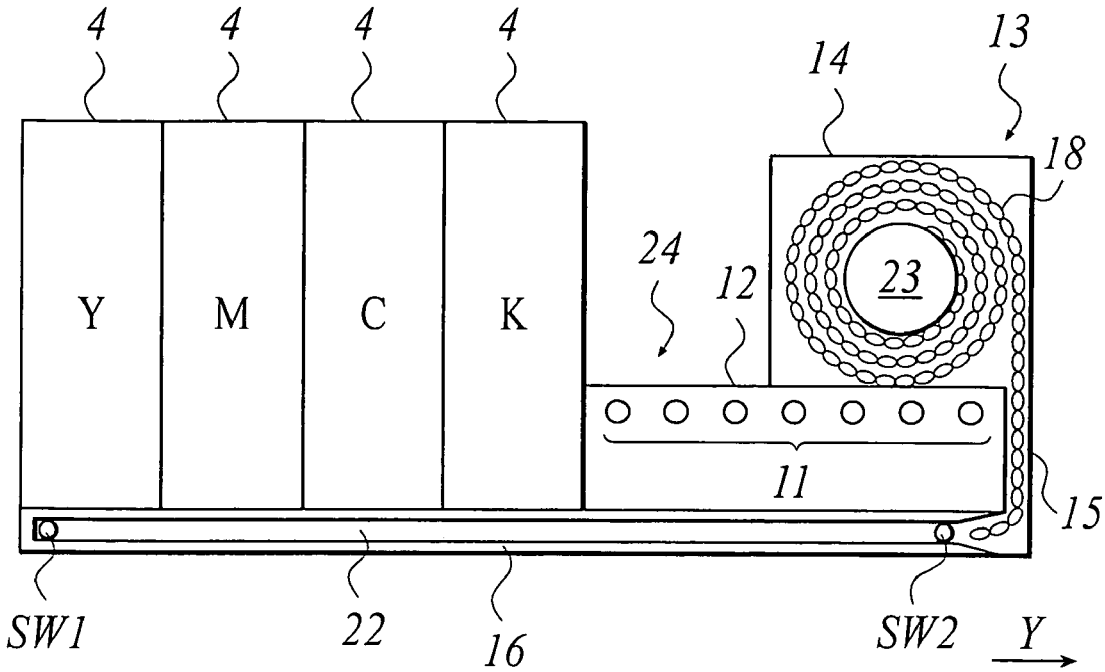
FIG. 10A is a section view taken along line A-A of FIG. 9 in the state that a protection member is stored in a storage unit in the fifth embodiment.
Figure 10B:
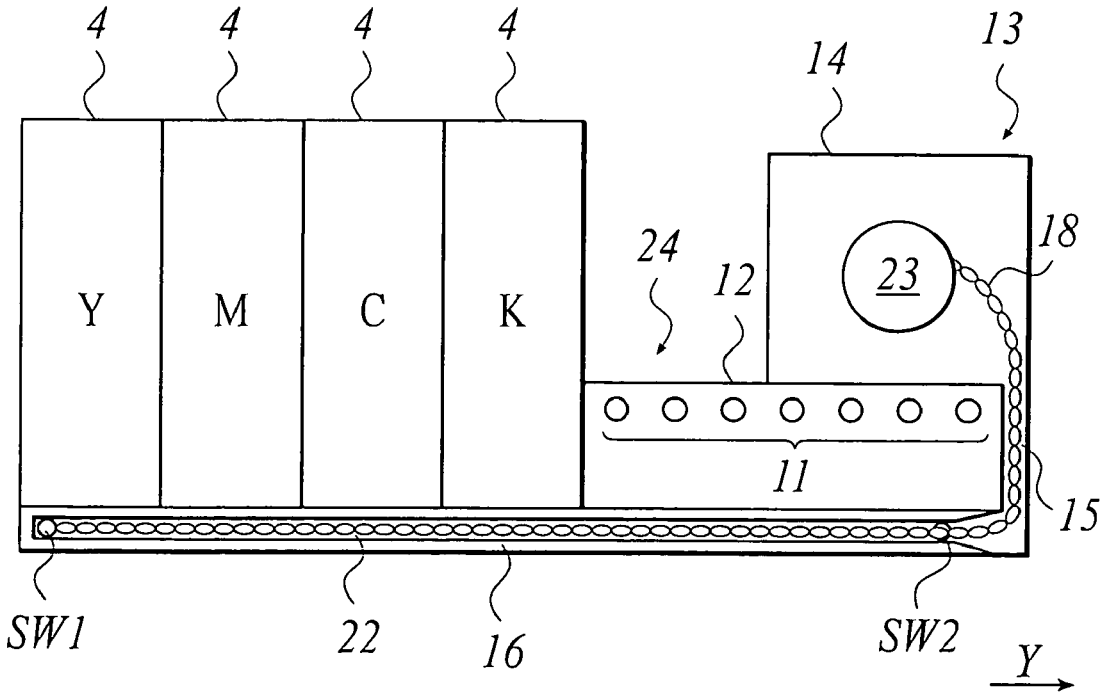
FIG. 10B is a section view taken along line A-A of FIG. 9 in the state that the protection member covers an opening on the undersurface of the UV irradiation device in the fifth embodiment.

Hereinafter, details of the protection mechanism will be explained with reference to the FIG. 9, FIG. 10A and FIG. 10B. FIG. 10A is a section view taken along line A-A of FIG. 9 in the state that the protection member 18 is stored in a storage unit 14. FIG. 10B is a section view taken along line A-A of FIG. 9 in the state that the protection member 18 covers an opening on the undersurface of the UV irradiation device 24.

The protection mechanism 13 comprises the storage unit 14, a rail 16, a motor 17 operating as a driving mechanism, and the protection member 18.

The storage unit 14 is placed on the upper surface of the UV irradiation device 24. The storage unit 14 is approximate rectangular solid shaped and the width thereof is as long as the width of the UV irradiation device 24 in the main scan direction X. The storage unit 14 is placed in the state that it slightly projects from the UV irradiation device 24 to the forward in the conveyance direction of the recording medium P. Then, the space between the front end face of the UV irradiation device 24 in the sub scan direction Y and the front end face of the storage unit 14 in the sub scan direction Y is the space for comings and goings of the protection member 18.

Further, the front end face of the storage unit 14 in the sub scan direction Y extends downward beyond the bottom edge of the UV irradiation device 24. Accordingly, a passage 15 having the predetermined distance between the front end face of the UV irradiation device 24 in the sub scan direction Y and the front end face of the storage unit 14 in the sub scan direction Y is formed.

In addition, each rail 16 for guiding the protection member 18 coming out of the storage unit 14 through the passage 15 is placed on each bottom edge of the end faces of the UV irradiation device 24 in the main scan direction X. Each rail 16 extends from the front edge of the UV irradiation device 24 in the sub scan direction Y to the most rear end face of the recording heads 4, 4, 4 and 4 in the sub scan direction Y. The front edge of each rail 16 in the sub scan direction Y is continued to the aforementioned passage 15.

On the faces of each rail 16 facing each other, a guide gutter 22 for guiding the protection member 18 is formed.

On one end face in the main scan direction X, the motor 17 for driving the protection member 18 is placed. A rotation axis 23 (FIG. 10A) extends along the main scan direction X. One end of the rotation axis 23 is connected to an axis of the motor 17 and the other is supported for being free to rotate, on the side face of the storage unit 14 facing the side face on which the motor 17 is placed.

For the protection member 18 in the fifth embodiment, a shutter similar to that of the third embodiment is applied.

Figure 11:
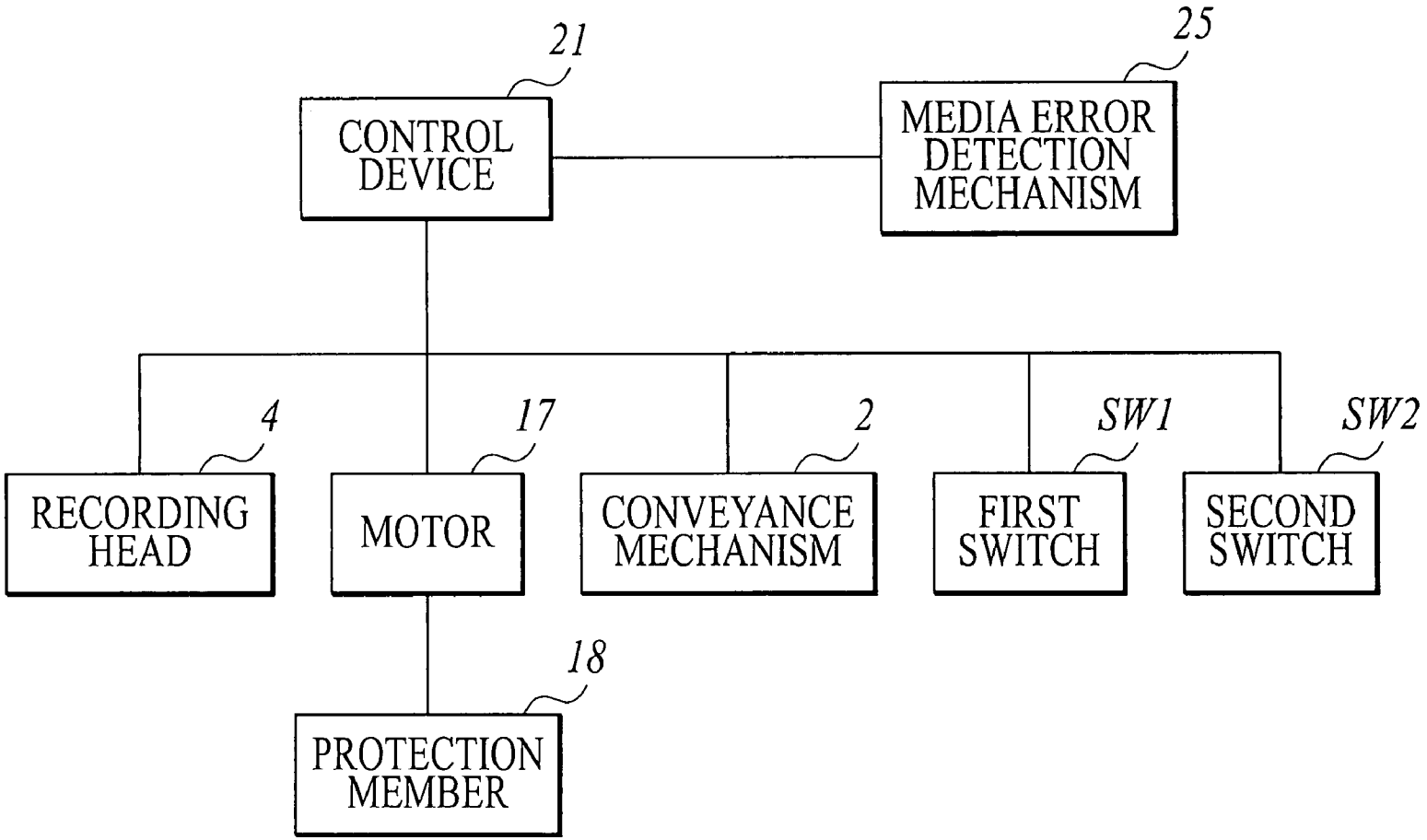
FIG. 11 is a block diagram of the inkjet printer in the fifth embodiment.

Next, a control device 21 of the inkjet printer 30 according to the fifth embodiment will be explained with reference to the FIG. 11. FIG. 11 is a function block diagram of the inkjet printer 30.

In the inkjet printer 30, a media error detection mechanism 25 for sending a signal (jam signal) to the control device 21 when the media error occurs, is placed. The media error detection mechanism 25 comprises a tachometer (not shown) for measuring the rotational speed of the conveyance rollers 2*a* and 2*a* of the conveyance mechanism 2. In addition, the media error detection mechanism 25 comprises a comparing unit (not shown) for comparing the difference between each rotational speed of the conveyance roller 2*a* and 2*a* with a specified value memorized beforehand.

The control device 21 is connected to the recording heads 4, 4, 4 and 4 to stop jetting the ink when the signal (the jam signal) is received. In addition, the control device 21 is connected to the motor 17 to place the protection member 18 between the recording medium P and the light source by driving the protection member 18. Moreover, the control device 21 is connected to a first switch SW1 for stopping the movement of the protection member 18 when the protection member is placed between the recording medium P and the light source. Additionally, the control device 21 is connected to a second switch for stopping the movement of the protection member 18 when the protection member 18 is pulled out after the media error is fixed.

In addition, the control device 21 is connected to the conveyance mechanism 2 to stop conveying the recording medium P when the signal (the jam signal) is received, and to prevent further deterioration of the media error.

Next, an operation of the inkjet printer 30 according to the fifth embodiment will be explained with reference to FIG. 9 to FIG. 11.

In the inkjet printer 30, the conveyance rollers 2*a* and 2*a* rotate, and the recording medium P is conveyed in the sub scan direction Y while the backside thereof (the opposite side to the recording surface) is supported by the platen 3. Accordingly, the ink is jetted form the recording heads 4, 4, 4 and 4 toward the recording medium P.

The jetted ink is cured with the irradiation of the ultraviolet rays from the UV irradiation device 24 which is placed to the downstream side of the recording heads 4, 4, 4 and 4 in the conveyance direction of the recording medium P.

When the media error occurs, the conveyance speed of the recording medium P goes wrong, and then the rotational speed results in differences between the conveyance rollers 2*a* and 2*a*. The difference of the rotational speed is measured by the comparing unit. In the case that the difference of the rotational speed exceeds the specified value, the media error detection mechanism 25 sends the signal (the jam signal) to the control device 21. Then, the control device 21 stops jetting the ink from the recording heads 4, 4, 4 and 4 and the conveyance of the recording medium P respectively, by controlling the recording heads 4, 4, 4 and 4 and the conveyance mechanism 2.

Therewith, the control device 21 controls and drives the motor 17 of the protection mechanism 13. Then, the rotation axis 23 continued to the motor 17 rotates. And then, the protection member 18 moves from the storage unit 14 so as to cover the UV irradiation device 24 and the recording heads 4, 4, 4 and 4, until the protection member 18 contacts the first switch SW1. Accordingly, the protection member 18 is placed between the ultraviolet rays source 11 and the recording heads 4, 4, 4 and 4, and the recording medium P.

In addition, when the media error is fixed, the motor 17 rotates in the reverse direction. Then, the protection member 18 is coiled around the rotation axis 23 until the contact between the protection member 18 and the second switch SW2 is lost. Accordingly, the protection member 18 is stored in the storage unit 14, in the state that the other end thereof is engaged with the guide gutter 22.

As mentioned above, in the inkjet printer 30 according to the fifth embodiment, when the media error is detected, the protection member 18 is placed immediately between the ultraviolet rays source 11 and the recording heads 4, 4, 4 and 4, and the recording medium P. Therefore, the ultraviolet rays source 11 and the recording heads 4, 4, 4 and 4 are protected from being contacted directly by the recording medium jammed with the media error. Further, the ultraviolet rays source 11 and the recording heads 4, 4, 4 and 4 are protected from breakage. In addition, even if the recording medium P is pulled out to fix the media error, the protection member 18 is already placed between the recording medium P, and the ultraviolet rays source 11 and the recording heads 4, 4, 4 and 4. Therefore, the light source 11 and the recording heads 4, 4, 4 and 4 are not contacted directly by the recording medium P. Accordingly, the ultraviolet rays source 11 and the recording heads 4, 4, 4 and 4 are protected from breakage.

Incidentally, in all the above-mentioned embodiments, it is preferred that the ultraviolet rays source 11 is kept on lighting, when the media error is detected and the protection member 18 covers the ultraviolet rays source 11. By doing so, the time required to stabilize the luminous energy of the ultraviolet rays source 11 can be shortened, compared with the case that the ultraviolet rays source 11 is re-lighted after the extinction thereof.

Incidentally, in all the above-mentioned embodiments, as the UV irradiation devices 24, the rectangular solid shaped ones are mentioned with examples. However, in the case that the protection mechanism 13 can be placed in the UV irradiation device 24, the shape of the UV irradiation device 24 is not limited to those mentioned above. For example, UV irradiation devices 24 having the section of hog-backed shape or trapezoidal shape are applicable.

Sixth Embodiment

Hereinafter, the sixth embodiment of the present embodiment will be explained with reference to the FIG. 12A and FIG. 12B. Incidentally, in addition to the structure of the inkjet printer 40 according to the third embodiment, an inkjet printer 60 according to the present invention comprises a luminous energy sensor 61, a display unit 62, and a control device 63 for controlling the display unit 62 based on a result measured by the luminous energy sensor 61. Except for such structure, the inkjet printer 60 has similar structure as that of the third embodiment. Therefore, hereinafter, the difference from the third embodiment will be explained mainly.

Figure 12A:
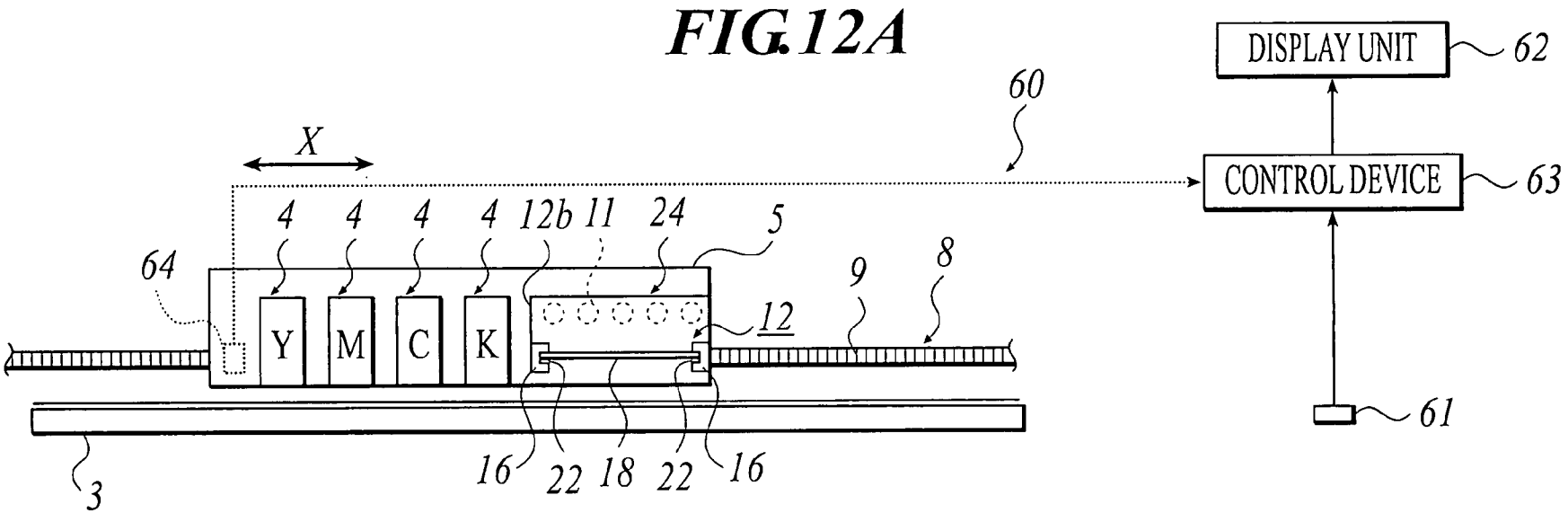
FIG. 12A is a pattern diagram showing the configuration in a sixth embodiment.
Figure 12B:
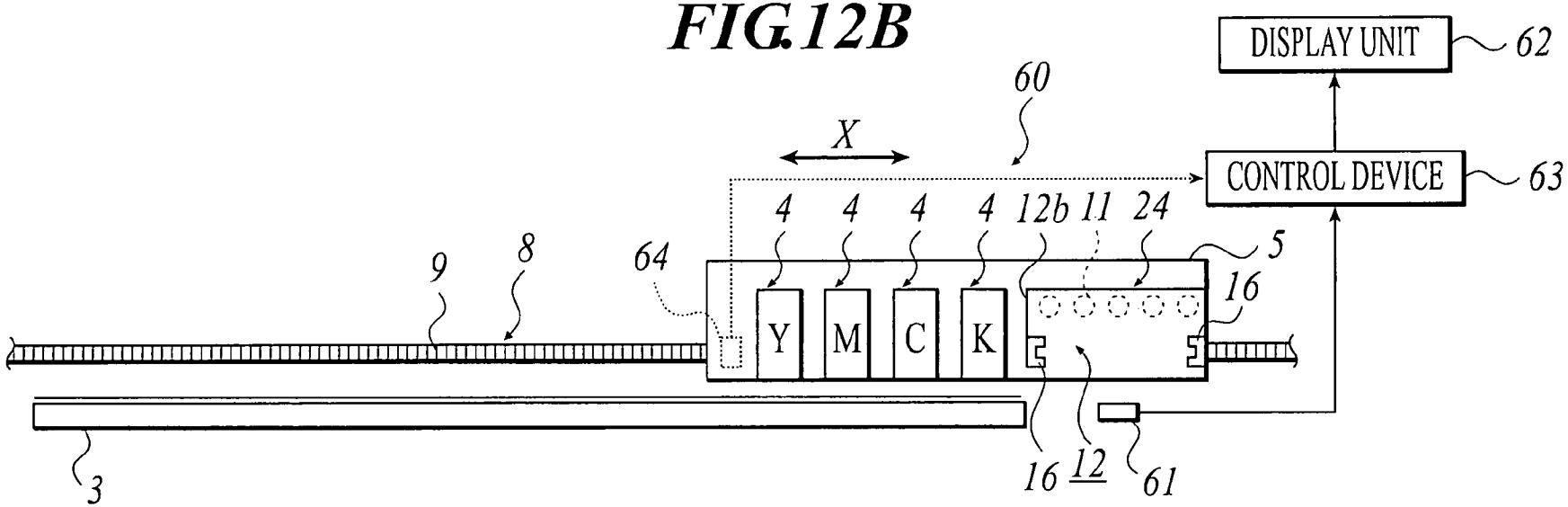
FIG. 12B is a pattern diagram showing condition of measuring of luminous energy of the ultraviolet rays irradiated by a UV irradiation device.

The inkjet printer 60 according to the present invention is a serial head type inkjet printer 60, as shown in FIG. 12A and FIG. 12B. A carriage 5 is placed so as to move back and forth in a main scan direction X along a guide member 8 by a carriage driving mechanism which is not shown in the figure. On the carriage 5, recording heads 4, 4, 4 and 4 for jetting the ink onto the recording medium P is mounted. On one side face of the carriage 5 in the main scan direction X, a UV irradiation device 24 for irradiating the ultraviolet rays to the ink, which is jetted from the recording heads 4, 4, 4 and 4 and landed on the recording medium P, is placed.

On the guide member 8, a striping 9 composing a linear encoder for measuring the speed of the carriage 5 is provided. On the backside of the carriage 5, a read sensor 64, which composes the linear encoder and generates a pulse signal by reading the striping 9, is placed. Incidentally, the linear encoder composes a media error detection mechanism.

The UV irradiation device 24 comprises a boxy cover 12 having an opening facing the recording medium P Inside of the cover 12, a plurality of linear shaped ultraviolet rays sources 11, of which length is approximately same as the length of the recording heads 4, 4, 4 and 4 in the secondary direction perpendicular to the main scan direction X, are arranged along the recording heads 4, 4, 4 and 4 in the main scan direction X. Inside of lower edges of the side faces of the cover 12, rails 16 and 16 extending along a sub scan direction are placed. On the faces of the rails 16 and 16 facing each other, guide gutters 22 and 22 for guiding the protection member 18 which covers the ultraviolet rays sources 11, are formed along the sub scan direction respectively.

A mid-portion of an area in which the carriage 5 can move is a recording area for recording onto the recording medium P. In the recording area, a platen 3 supporting the recording medium P flatly from the backside. In addition, in the inkjet printer 60, a conveyance mechanism for conveying the recording medium P in the sub scan direction is placed. In the position which is one side of the platen 3 in the main scan direction X and in which the UV irradiation device 24 can move, the luminous energy sensor 61 as the luminous energy measuring member for measuring the luminous energy of the ultraviolet rays irradiated from the ultraviolet rays source 11, which comprises a photo diode for example, is placed.

In addition, in the upper portion of the housing of the inkjet printer 60, a display unit 62 as a warning member, which comprises a liquid crystal display for example, for displaying various messages, is placed. Further, an input operation unit (not shown) for inputting instructions from the user is also placed in the upper portion of the housing.

In addition, the inkjet printer 60 comprises the control device 63. The control device 63 controls the movement of each member, based on statuses such as operations or the like of the carriage driving mechanism, the conveyance mechanism, the recording heads 4, 4, 4 and 4, the UV irradiation device 24 or the like, according to various processing programs.

In particular, in the inkjet printer 60, the read sensor 64 is connected to the control device 63. Then, the control device 63 recognizes the movement speed of the carriage 5 based on the pulse signal sent from the read sensor 64. Here, in the case that the recording medium P interferes the carriage 5 for the reason of the imperfect conveyance of the recording medium P, the movement speed of the carriage 5 is decreased. Therefore, in the case that the recognized movement speed of the carriage 5 is smaller than a predetermined value, the control device 5 judges that the media error occurs.

In addition, to the control device 63, the luminous energy sensor 61 is connected. The control device 63 makes the luminous energy sensor 61 measure the luminous energy of the ultraviolet rays from the ultraviolet rays source 11, before the recording operation is started again after the recordable status is returned with pulling out the recording medium P which caused the imperfect conveyance. Then, the control device 63 judges whether the image-recording can be carried out, based on a result measured by the luminous energy sensor 61. Accordingly, the control device 63 makes the display unit 62 display the judged result.

Concretely, in the control device 63, a reference value, which can make the ink landed on the recording medium P be cured well by the UV irradiation device 24, is memorized beforehand. The control device 63 compares the measured value measured by the luminous energy sensor 61 with the reference value. Then, in the case that the measured value is lower than the reference value, the ink cannot be cured well for the reason of decrease of the luminous energy. Accordingly, in such case, the control device 63 judges that the image-recording cannot be carried out. Then, in the case that the control device 63 judges that the image-recording cannot be carried out, the control device 63 makes the display unit 62 display the warning message accordingly.

Incidentally, in the present embodiment, the warning member comprises the display unit 62, and the warning message is displayed in the display unit 62. However, a warning member is not limited to that. For example, an audio output device may be provided as the warning member. Accordingly, a warning buzzer or a message may be output by audio. In addition, a light may be turned on by providing a warning lamp as the warning member.

Further, the resumption of the image-recording operation may be inhibited. In other words, the control device 63 may control the carriage driving mechanism, the conveyance mechanism and the recording heads 4, 4, 4 and 4 so that the operation for the image-recording is not resumed.

Next, action of the present embodiment will be explained.

When an image is recorded on the recording medium P, the ink of predetermined colors are jetted from the recording heads 4, 4, 4 and 4 based on the predetermined image information, while the carriage 5 moves back and forth in the main scan direction X over the recording medium P conveyed intermittently in the sub scan direction. The ink jetted from the recording heads 4, 4, 4 and 4 are landed sequentially on the recording medium P. Then, the ultraviolet rays are irradiated to the ink sequentially by the UV irradiation device 24 which goes back and forth along with the carriage 5. Accordingly, by curing the ink on the recording medium P, the image is recorded on the recording medium P.

During the image is recorded on the recording medium P, the striping 9 is read by the read sensor 64 according to the movement of the carriage 5. The result of the reading is sent to the control device 63 as a pulse signal. Accordingly, the movement speed of the carriage 5 is recognized based on the pulse signal by the control device 63. Then in the case that the movement speed is lower than the predetermined value, the media error is detected.

When the media error is detected, each movement of the carriage driving mechanism, the conveyance mechanism, the recording heads 4, 4, 4 and 4, and the UV irradiation device 24 is stopped.

On this occasion, the user inserts the protection member 18 along the guide gutter 22 of the rail 16 placed on the cover 12 of the UV irradiation device 24. By doing so, the opening of the cover 12 is covered with the protection member 18. In such condition, by the action that the user removes the recording medium P which caused the imperfect conveyance from the device, the ultraviolet rays source 11 is protected from contact directly by the recording medium P during the removal.

After the recording medium P which caused the imperfect conveyance is removed, the user removes the protection member 18 inserted into the rail 16 of the UV irradiation device 24, by sliding the protection member 18 along the guide gutter 22. Then, an instruction for returning the recordable status is input from the input operation unit by the user. According to the instruction, as shown in FIG. 12B, the carriage driving mechanism is driven by the control device 63. Accordingly, the carriage 5 is moved to the position where the UV irradiation device 24 faces the luminous energy sensor 61. Then, the luminous energy of the ultraviolet rays from the ultraviolet rays source 11 is measured by the luminous energy sensor 61. In addition, the measured value and the pre-memorized reference value which can cure the ink landed on the recording medium P well, are compared each other by the control device 63. In the case that the measured value is greater than or equal to the reference value, each operation of the carriage driving mechanism, the conveyance mechanism, the recording heads 4, 4, 4 and 4, and the UV irradiation device 24 is stared. Accordingly, the image-recording operation is resumed. In the case that the measured value is lower than the reference value, the ink cannot be cured well because of the decrease of the luminous energy. Therefore, the control device 63 judges that the image-recording cannot be carried out. Further, the control device 63 makes the display unit 62 display the warning message accordingly.

Therefore, the massage that the image-recording can not be carried out is displayed in the display unit 62, in the case as follows; when the recording medium P causes the imperfect conveyance, before the protection member 18 is attached in the UV irradiation device 24, the ultraviolet rays source 11 is broken because the recording medium P contacts the ultraviolet rays source 11, or the recording medium P sticks to the ultraviolet rays source 11 because the recording medium P, to which a synthetic resin film is used, is melted with the heat generated by the ultraviolet rays source 11, and consequently the luminous energy of the ultraviolet rays decreases until the ink cannot be cured well.

As mentioned above, according to the present embodiment, when the media error occurs, the protection member 18 is attached to the UV irradiation device 24 by the user. Accordingly the opening is covered with the protection member 18. Therefore, when the recording medium P which caused the imperfect conveyance is removed by the user, the ultraviolet rays source 11 can be protected from being broken by the recording medium P contacting with the ultraviolet rays source 11, or being stuck by the recording medium P.

In addition, the massage that the image-recording can not be carried out is displayed in the case as follows; when the recording medium P causes the media error, the ultraviolet rays source 11 is broken, or the recoding medium P sticks to the ultraviolet rays source 11, and consequently the ink cannot be cured because the luminous energy of the ultraviolet rays decreases. Accordingly, the operation of the image-recording in state that the ink cannot be cured, can be prevented. As a result, wasting of the recording medium P or the ink are prevented.

The entire disclosure of Japanese Patent Application No. Tokugan 2003-35183 filed on Feb. 13, 2003 including specification, claims, drawings and summary are incorporated herein by reference in its entirety.

What is claimed is:

1. An inkjet printer comprising:

a recording head for jetting ink cured with irradiation of light, onto a recording medium;

a light source for irradiating the light toward the ink jetted on the recording medium, the light source being provided so as to face the recording medium;

a media error detection mechanism for detecting a media error of the recording medium;

a conveyance mechanism for conveying the recording medium in a predetermined direction;

a control device for controlling the recording head and the conveyance mechanism, the control device controlling the conveyance mechanism to stop conveying the recording medium, and controlling the recording head to stop jetting the ink, when the media error of the recording medium is detected by the media error detection mechanism; and a protection member is placed between the light source and the recording medium and the protection member is further placed between the recording head and the recording medium when the media error is detected.

2. The inkjet printer of claim 1, wherein the protection member comprises heat insulating material.

3. The inkjet printer of claim 1, wherein the protection member is formed in a meshed shape.

4. The inkjet printer of claim 1, further comprising a driving mechanism for driving the protection member, wherein the control device controls the driving mechanism to place the protection member between the light source and the recording medium, when the media error is detected by the media error detection mechanism.

5. The inkjet printer of claim 1, further comprising a head moving mechanism for moving the recording head of a serial print type in a direction perpendicular to a conveyance direction of the recording medium, wherein the control device controls the head moving mechanism to stop, when the media error of the recording medium is detected by the media error detection mechanism.

6. The inkjet printer of claim 1, wherein the recording head is of a line print type.

7. The inkjet printer of claim of 1, wherein the ink is UV curable ink capable of being cured with irradiation of ultraviolet rays.

8. The inkjet printer of claim 7, wherein the UV curable ink is cationic polymerization system ink.

9. The inkjet printer of claim 1, which forms an image by jetting the ink onto the recording medium.

10. An inkjet printer comprising:

a recording head for jetting ink cured with irradiation of light, onto a recording medium;

a light source for irradiating the light toward the ink jetted on the recording medium the light source being provided so as to face the recording medium;

a media error detection mechanism for detecting a media error of the recording medium;

a conveyance mechanism for conveying the recording medium in a predetermined direction;

a control device for controlling the recording head and the conveyance mechanism, the control device controlling the conveyance mechanism to stop conveying the recording medium, and controlling the recording head to stop jetting the ink, when the media error of the recording medium is detected by the media error detection mechanism; and a protection member capable of being placed between the light source and the recording medium when the media error is detected further comprising a luminous energy measuring member for measuring luminous energy of the light source, wherein the control device makes the luminous energy measuring member measure the luminous energy, before a recording operation is resumed after the media error is detected by the media error detection mechanism and the recording operation is stopped, and judges that the control device cannot carry out the recording when the luminous energy measured by the luminous energy measuring member is lower than a predetermined value.

11. The inkjet printer of claim 10, further comprising a warning member for warning a user, wherein the control device makes the warning member warn, when the control device judges that the recording operation cannot be carried out.

12. The inkjet printer of claim 10, wherein the control device prohibits resumption of the recording operation, when the control device judges that the recording operation cannot be carried out.

* * * * *